United States Patent [19]

Kimura et al.

[11] Patent Number: 4,502,844

[45] Date of Patent: Mar. 5, 1985

[54] REFRIGERANT COMPRESSOR WITH MECHANISM FOR ADJUSTING CAPACITY OF THE COMPRESSOR

[75] Inventors: Shogo Kimura, Yabuzukahonmachi; Haruo Takahashi, Takasaki, both of Japan

[73] Assignee: Sanden Corporation, Gunma, Japan

[21] Appl. No.: 435,629

[22] Filed: Oct. 20, 1982

[30] Foreign Application Priority Data

Oct. 27, 1981 [JP] Japan ..... 56-159023[U]

[51] Int. Cl.[3] ..... F04B 49/00

[52] U.S. Cl. ..... 417/275; 92/60.5

[58] Field of Search ..... 92/60.5; 407/274–277, 407/269; 62/228.5

[56] References Cited

U.S. PATENT DOCUMENTS

| | | | |
|---|---|---|---|
| 1,997,476 | 4/1935 | Wallene | 417/274 |
| 2,779,528 | 1/1957 | Jensen | 92/60.5 |
| 3,945,765 | 3/1976 | Toyoda et al. | 417/269 |
| 3,972,652 | 8/1976 | Minnicino | 92/60.5 X |
| 3,998,570 | 12/1976 | Jacobs | 92/60.5 |

FOREIGN PATENT DOCUMENTS

| | | | |
|---|---|---|---|
| 2000009 | 7/1971 | Fed. Rep. of Germany | 417/274 |

*Primary Examiner*—Edward K. Look

*Attorney, Agent, or Firm*—Banner, Birch, McKie & Beckett

[57] ABSTRACT

A reciprocating piston type refrigerant compressor is disclosed which includes a compressor housing having a cylinder block provided with a plurality of cylinders and a crank chamber adjacent the cylinder block. A piston slides within each cylinder and is reciprocated by a wobble plate driven by a cam rotor. A drive shaft is connected to the cam rotor to drive the cam rotor. A front end plate is disposed on an opening of the crank chamber; the front end plate rotatably supports the drive shaft. A rear end plate is fixed on the opposite end of the compressor housing together with a valve plate which includes a suction chamber and a discharge chamber. The rear end plate is provided with a plurality of dead space chambers, each of which is connected with one of the cylinders through a hole formed through the valve plate. A valve is slidably disposed within the dead space chamber to control the opening and closing of the hole in the valve plate. The valve is controlled by a valve control device supported by the rear end plate. The valve control device is responsive to the environment to adjust the capacity of the compressor by controlling the operation of the valves.

7 Claims, 4 Drawing Figures

REFRIGERANT COMPRESSOR WITH MECHANISM FOR ADJUSTING CAPACITY OF THE COMPRESSOR

BACKGROUND OF THE INVENTION

This invention relates to a compressor, and more particularly, to a reciprocating piston type compressor for an air conditioning apparatus which includes a mechanism for adjusting the capacity of the compressor.

Generally, in air conditioning apparatus, thermal control is accomplished by intermittent operation of the compressor in response to a signal from a thermostat located in the room being cooled. Once the temperature in the room has been lowered to a desired temperature, the refrigerant capacity of the air conditioner generally need not be very large in order to handle supplemental cooling because of further temperature changes in the room, or for keeping the room at the desired temperature. However, prior art air conditioners do not have capacity control mechanisms so that, after the room has cooled down to the desired temperature, the manner for controlling the output of the compressor is by intermittent operation of the compressor. Thus, the relatively large load which is required to drive the compressor is intermittently applied to the driving source.

When a compressor is used in an automobile air conditioner, the compressor is driven by the engine of the automobile through an electromagnetic clutch. Such prior art automotive air conditioners face the same load problems described above once the passenger compartment reaches a desired temperature. Control of the compressor is accomplished by intermittent operation of the compressor through the magnetic clutch which couples the automobile engine to the compressor. Thus, the relatively large load which is required to drive the compressor is intermittently applied to the automobile engine.

Furthermore, since the compressor of an automobile air conditioner is driven by the engine of the automobile, the rotation frequency of the drive mechanism changes from moment to moment, which causes the refrigerant capacity to change in proportion to the rotation frequency of the engine. Since the capacity of the evaporator and condenser of the air conditioner does not change, when the compressor is driven at high rotation, the compressor performs useless work. To avoid useless work by the compressor, prior art automobile compressors are controlled by intermittent operation of the magnetic clutch. Therefore, a large load is intermittently applied to the automobile engine.

SUMMARY OF THE INVENTION

It is a primary object of this invention to provide an improved refrigerant compressor wherein a mechanism for adjusting the capacity of the compressor is included to reduce the intermittent operation of the drive source.

It is another object of this invention to provide a refrigerant compressor wherein the load of the driving source for driving the compressor is reduced, and consumption of energy by the compressor is reduced.

According to one aspect of this invention, a refrigerant compressor includes a compressor housing having a cylinder block with a plurality of cylinders and a crank chamber adjacent the cylinder block. A piston slides within each cylinder and is reciprocated by a wabble plate driven by an input cam rotor. An input drive shaft is connected to the cam rotor. A front end plate is disposed on an opening of the crank chamber; the front end plate rotatably supports the drive shaft through a bearing. A rear end plate, which is disposed on the opposite end of the housing, includes a suction chamber and discharge chamber for refrigerant. The rear end plate is fixed on the housing together with a valve plate. The rear end plate has a plurality of dead space chambers, each of which is connected with one of the cylinders through a hole formed in the valve plate. A valve is movably disposed within the dead space chamber to control the opening and closing of the holes in the valve plate. The movement of the valve is controlled by the operation of a control device disposed within the rear end plate. Therefore, each cylinder is selectively connected with a dead space chamber by the operation of the valve so that the capacity of the compressor can be changed in response to the external environment, for example, the rotation frequency of the driving source, the room temperature, the temperature of the evaporator, etc.

Further objects, features and other aspects of the invention will be apparent from the following detailed description of the preferred embodiment of this invention when read in conjunction with the annexed drawings.

DETAILED DESCRIPTION OF THE PREFERRED EMBODIMENT

Figure 1:
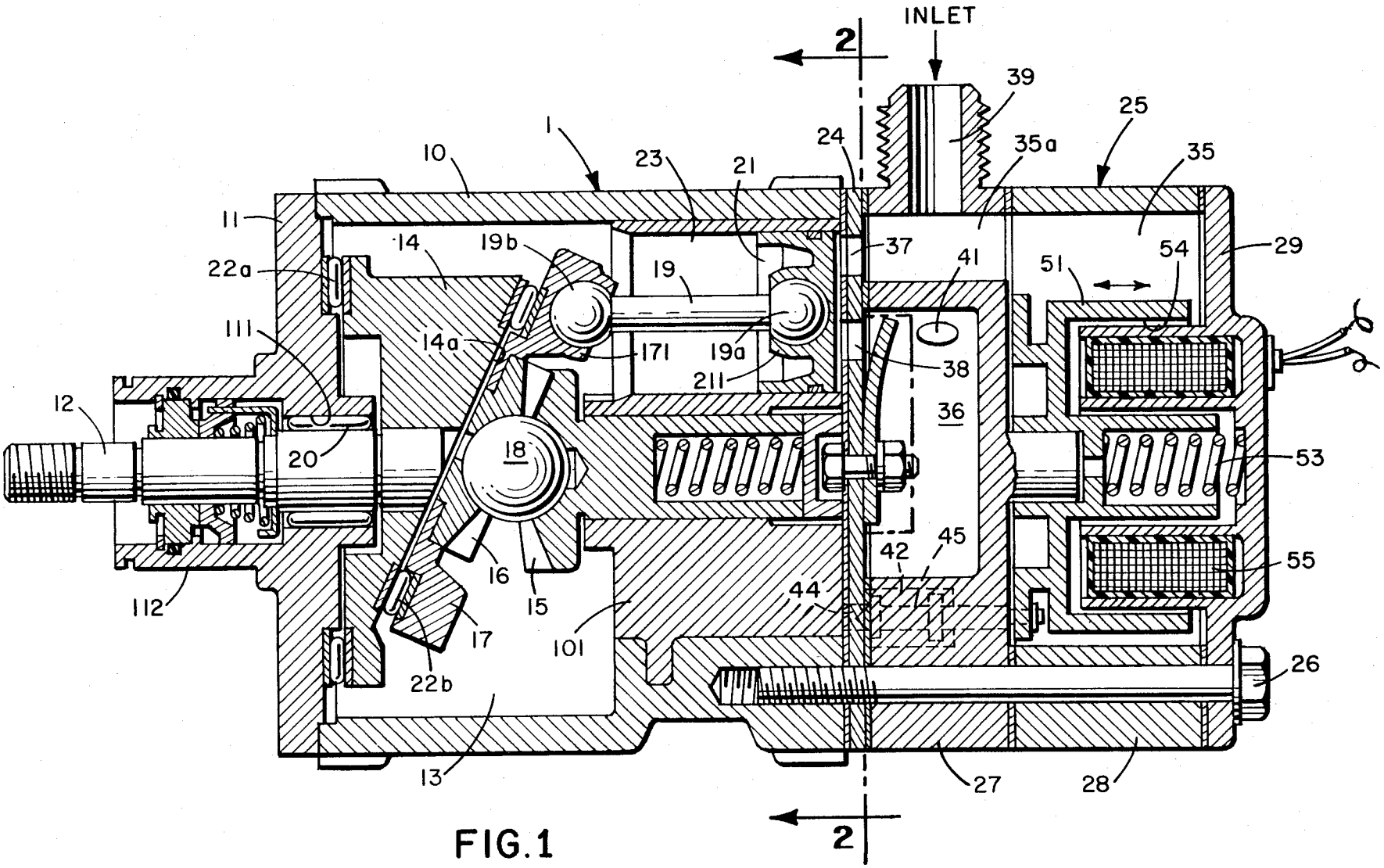
FIG. 1 is a vertical sectional view of a refrigerant compressor according to one embodiment of this invention.

Referring to FIG. 1, a refrigerant compressor according to the invention is shown. The compressor, generally designated 1, includes a closed cylindrical housing assembly 10 formed by cylinder block 101, a hollow portion such as crank chamber 13, front end plate 11 and rear end plate 25.

Front end plate 11 is mounted on the left end portion of crank chamber 13 by a plurality of screws (not shown). Rear end plate 25 and valve plate 24 are mounted on cylinder block 101 by a plurality of screws 26, one of which is shown in FIG. 1. An opening 111 is formed in front end plate 11 for receiving drive shaft 12, which is rotatably supported in opening 111 by a bearing, such as needle bearing 20. Annular sleeve 112 projects from the front end surface of front end plate 11 and surrounds drive shaft 12 to define a shaft seal cavity. A shaft seal assembly is disposed on drive shaft 12 within the seal cavity.

Drive shaft 12 is provided with a swash plate or cam rotor 14 at its inner end portion, and cam rotor 14 is rotated along with drive shaft 12. Thrust needle bearing **22*a* is disposed between the inner surface of front end plate 11 and the adjacent axial end surface of cam rotor 14. The outer end of drive shaft 12, which extends outwardly from sleeve 112**, is driven by the engine of the vehicle through a conventional clutch and pulley arrangement.

The sloping surface 14a of cam rotor 14 is placed in close proximity to the surface of wobble plate 17, which is mounted on an oscillating bevel gear 16. Thrust needle bearing 22b is disposed between sloping surface 14a and wobble plate 17. Wobble plate 17 nutates or oscillates about ball bearing 18 seated within fixed bevel gear 15. The engagement of bevel gears 15 and 16 prevents rotation of wobble plate 17 as described in U.S. Pat. No. Re. 27,844 issued to Olson.

Figure 2:
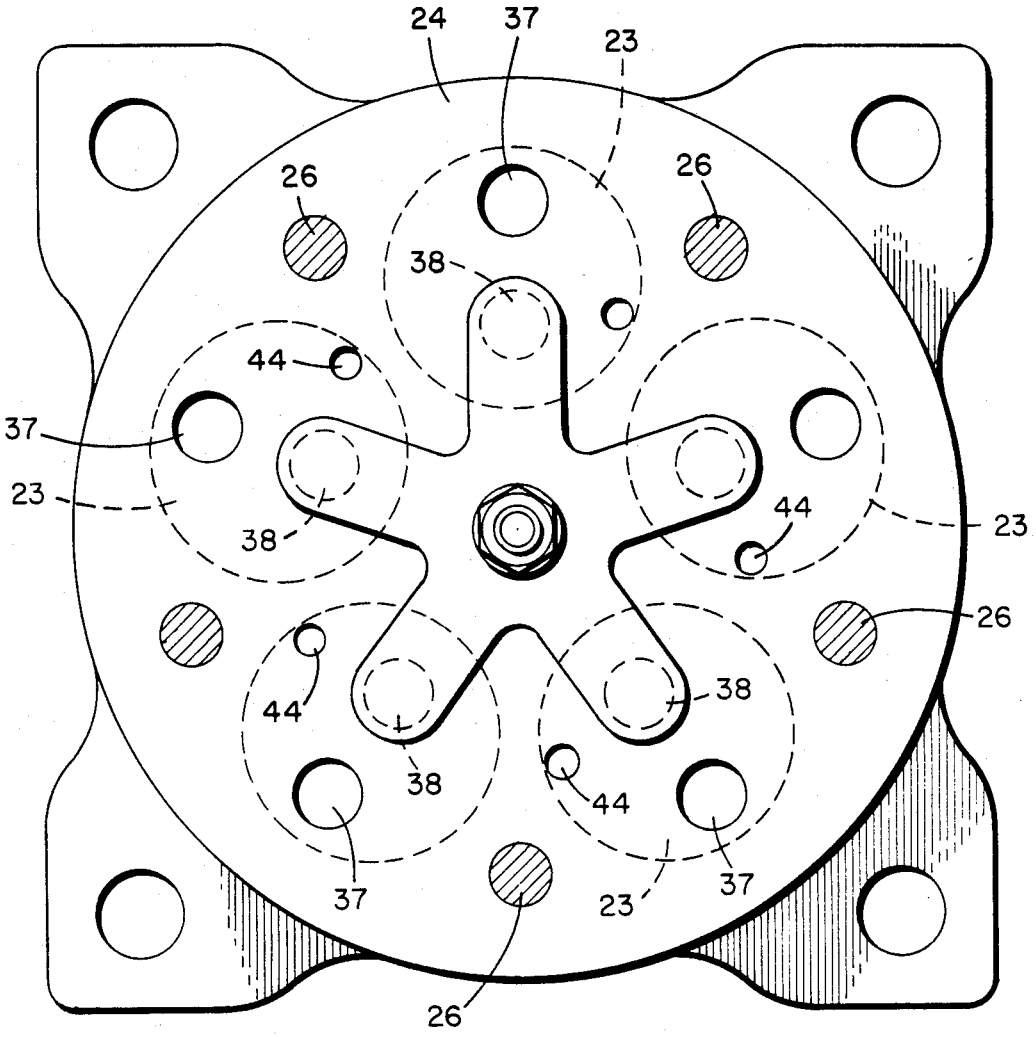
FIG. 2 is a cross sectional view taken along the line II—II in FIG. 1.

Cylinder block 101 has a plurality of annularly arranged cylinders 23 in which pistons 21 slide. A typical arrangement would include five cylinders as illustrated in FIG. 2, but a smaller or larger number of cylinders may be provided. All pistons 21 are connected to wobble plate 17 by connecting rods 19. Ball 19a at one end of rod 19 is received in socket 211 formed in piston 21 and ball 19b at the other end of rod 19 is received in socket 171 formed in wobble plate 17. It should be understood that, although only one such ball socket connection is shown in FIG. 1, there are plurality of sockets arranged peripherally around wobble plate 17 to receive the balls of various rods, and that each piston 21 is formed with a socket for receiving the other ball of the rods.

Rear end plate 25 includes first head portion 27, second head portion 28 and head cover plate 29. Rear end plate 25 is fixed on one end of cylinder block 101 together with valve plate 24 by a plurality of screws 26 which extend through first and second head portions 27 and 28. Rear end plate 25 is shaped to define suction chamber 35 and discharge chamber 36. Valve plate 24 is provided with a plurality of suction ports 37 connected between suction chamber 35 and the respective cylinders 23. Also, a plurality of discharge ports 38 are connected between discharge chamber 36 and the respective cylinders 23. Suitable reed valves for suction ports 37 and discharge ports 38 are disposed as described in U.S. Pat. No. 4,011,029 issued to Shimizu.

In operation, drive shaft 12 is rotated by the engine of the vehicle, and cam rotor 14 is rotated together with drive shaft 12 to cause a nonrotatable wobbling motion of wobble plate 14 and ball bearing 18. As wobble plate 17 moves, pistons 21 reciprocate out of phase in their respective cylinders 23. Upon reciprocation of the pistons, the refrigerant gas, which is introduced into discharge chamber 35 from fluid inlet port 39 on first head portion 27, is taken into each cylinder through suction ports 37. The compressed gas within cylinders 23 is discharged to discharge chamber 36 from each cylinder 23 through discharge ports 38, and therefrom, discharged into an external fluid circuit, for example, a cooling circuit, through fluid outlet port 41 on first head portion 27.

Figure 3:
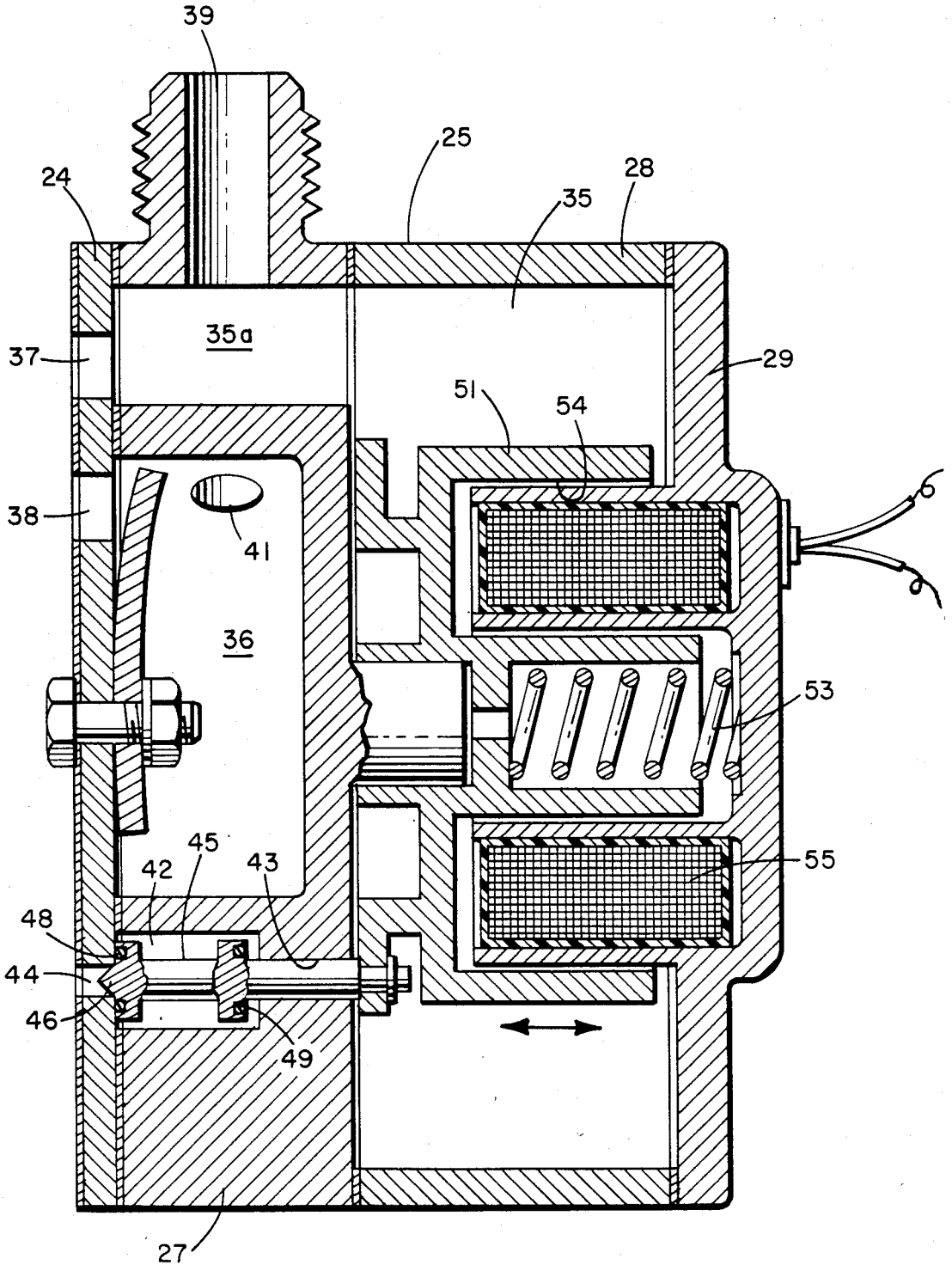
FIG. 3 is a vertical sectional view of the main parts of the rear end plate of the compressor of FIG. 1.
Figure 4:
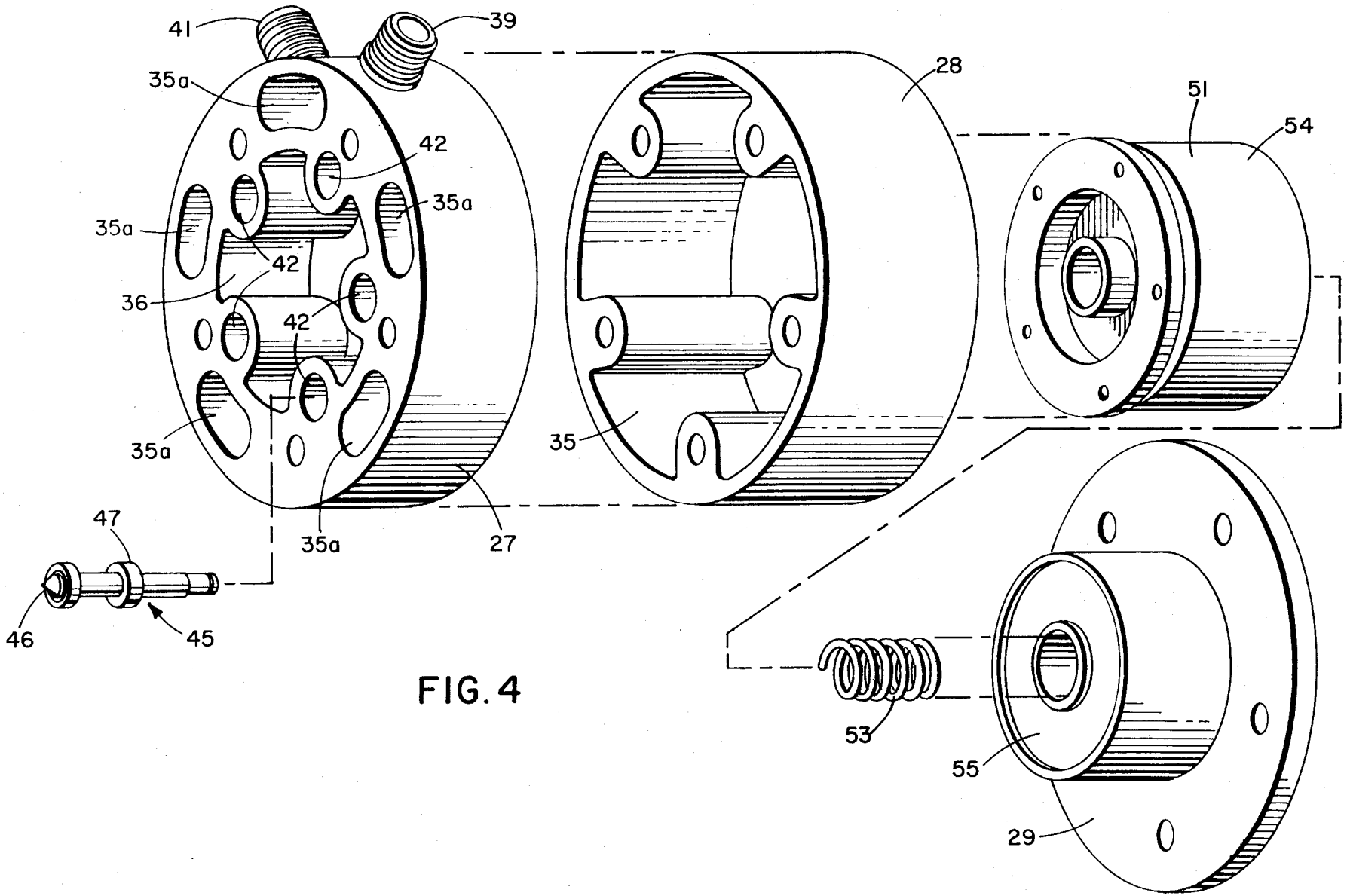
FIG. 4 is an exploded perspective view of the rear end plate portion of the compressor of FIG. 1.

Referring to FIGS. 3 and 4, rear end plate member 25 includes a mechanism for adjusting the displacement of the compressor. First head portion 27 has an annular shape and is provided with a round shaped indentation at its center which forms suction chamber 36. First head portion 27 has a plurality of suction bores 35a, each of which is connected between suction chamber 35 and each cylinder 23 through suction ports 37 at the outer peripheral portion of valve plate 24. One suction bore 35a is connected with fluid inlet port 39 as shown in FIG. 3. A plurality of dead space chambers 42 are formed in an axial end surface of first head portion 27 facing valve plate 24. The number of dead space chambers 42 corresponds to the number of cylinders 23. A hole 43 is formed through first head portion 27 at the end of each dead space chamber 42. Valve plate 24 has a plurality of connecting holes 44, each of which faces one of the dead space chambers 42. A valve 45 is slidably disposed within each dead space chamber 42. One end portion of valve 45 penetrates hole 43 to permit sliding movement of valve 45 so that valve member 45 is able to move axially within dead space chamber 42. Valve 45 has valve head 46 at its other end for opening and closing hole 44 of valve plate 24. The stroke of valve 45 within dead space chamber 42 is limited by flange 47 of valve 42. A sealing member 48 is disposed on valve head 46 of valve 45 to seal valve 24 and head 46 of valve 45. Another sealing member 49 is disposed on flange 47 of valve 45 to seal flange 47 and the end of dead space chamber 42 to prevent fluid leakage through hole 43.

Second head portion 28 is an annular cylindrical member having one end covered by head cover plate 29. Second head portion 28 forms suction chamber 35. Second head portion 28 also contains armature plate 51 at its center. Armature plate 51 moves within second head portion 28, the direction of motion of armature plate 51 being shown by an arrow in FIG. 3. Armature plate 51 is urged toward first head portion 27 by spring 53 disposed between armature plate 51 and head cover plate 29. The outer ends of valves 45, which extend from hole 43, are connected to armature plate 51, respectively. Armature plate 51 has an annular cavity 54 which surrounds an annular shaped magnetic coil 55 disposed on head cover plate 29. An annular shaped casing for magnetic coil 55 is formed integral with cover plate 29 as shown in FIG. 3. Alternatively, the casing for magnetic coil 55 can be formed separately from cover plate 29 and fitted on the inner end surface of cover plate 29.

In the above construction, if magnetic coil 55 is energized, armature plate 51 is attracted toward head cover plate 29 against the bias of spring 53. Valve 45 then moves with armature plate 51 to open connecting hole 44. Thus, the fluid in cylinder 23 flows into dead space chamber 42 through connecting hole 44 of valve plate 24. At this time, sealing member 49 fits against the end portion of dead space chamber 42 to prevent fluid leakage through hole 43. Therefore, dead space chambers 42 operate to re-expand the volume of the cylinders 23 which reduces the capacity of the compressor.

When magnetic coil 55 is not energized, armature plate 51 is pushed toward first heat portion 27 by the bias of spring 53. Valve 45 then is pushed against valve plate 24 and valve head 46 is seated in connecting hole 44 of valve plate 24 to close the opening of connecting hole 44. Sealing member 48 is located between valve plate 24 and valve head 46 of valve 45 to prevent fluid leakage into dead space chamber 42 from cylinder 23. In this condition, the compressor undergoes normal operation.

As mentioned above, the displacement of the compressor of the present invention is controlled by the operation of magnetic coil 55, which controls the movement of valves 45. Magnetic coil 55 usually is controlled by an external environmental condition of the air conditioner, such as rotation frequency, room temperature, evaporator temperature, evaporating pressure, etc. A device for controlling the operation of magnetic coil 55 is disclosed in commonly assigned application Ser. No. 451,941. The device includes a temperature detector for detecting the temperature of the cool air blown by the compressor.

Although the present invention has been described in detail in connection with a preferred embodiment, it will be understood by those skilled in the art that this embodiment is only for illustration. Various modifications may be made without departing from the scope of this invention.

We claim:

1. In a refrigerant compressor including a compressor housing having a cylinder block provided with a plurality of cylinders and a crank chamber adjacent said cylinder block, a piston slidable within each of said cylinders and reciprocated by a wobble plate driven by an input rotor, an input shaft connected to said input rotor to drive said input rotor, said input shaft rotatably supported by a front end plate disposed on one end of said compressor housing, and a rear end plate disposed on the opposite end of said compressor housing having a suction chamber and a discharge chamber, the improvement comprising:

a rear end plate fixed on said compressor housing together with a valve plate and having a plurality of dead space chambers, each of said dead space chambers being connected to one of said cylinders through connecting holes formed in said valve plate;

valve means movably disposed within each of said dead space chambers for controlling the opening and closing of said connecting holes; and valve control means disposed within said suction chamber of said rear end plate and operatively connected to said valve means for controlling the movement of said valve means to adjust the capacity of the compressor in response to external conditions.

2. The refrigerant compressor of claim 1 wherein said valve means has a valve head which faces an opening in said connecting hole and a flange to limit the stroke of said valve means within said dead space chamber.

3. The refrigerant compressor of claim 2 wherein the end of said valve means opposite said valve head is connected to said valve control means.

4. The refrigerant compressor of claim 3 wherein said valve control means comprises an armature plate which is connected to one end of each of said valve means, a magnetic coil and a spring disposed between said armature plate an an inner side surface of said rear end plate to urge said armature plate toward said compressor housing to close said dead space chamber.

5. The refrigerant of claim 1 wherein said rear end plate comprises a first head member, a second head member and a cover plate member, said first head member having a discharge chamber and said dead space chambers, said valve control means being disposed within a space defined by said second head member and said cover plate member.

6. The refrigerant compressor of claim 5 wherein said valve control means comprises an armature plate and a magnetic coil, said magnetic coil being contained within an annular shaped casing formed integral with said cover plate member.

7. The refrigerant compressor of claim 1 wherein said valve control means comprises an armature plate which is connected to one end of each of said valve means, a magnetic coil and a spring disposed between said armature plate and an inner side surface of said rear end plate to urge said armature plate toward said compressor housing to close said dead space chamber.

* * * * *